US009851178B2

(12) United States Patent
Cosso

(10) Patent No.: US 9,851,178 B2
(45) Date of Patent: Dec. 26, 2017

(54) LASER SIGHT WITH PROXIMITY SENSOR

(71) Applicant: Frank T. Cosso, Reno, NV (US)

(72) Inventor: Frank T. Cosso, Reno, NV (US)

( * ) Notice: Subject to any disclaimer, the term of this patent is extended or adjusted under 35 U.S.C. 154(b) by 46 days.

(21) Appl. No.: 14/796,914

(22) Filed: Jul. 10, 2015

(65) Prior Publication Data

US 2017/0010067 A1 Jan. 12, 2017

(51) Int. Cl.
*F41G 1/35* (2006.01)
*F41A 19/11* (2006.01)

(52) U.S. Cl.
CPC ..... *F41G 1/35* (2013.01); *F41A 19/11* (2013.01)

(58) Field of Classification Search
CPC ... F41G 1/32; F41G 1/34; F41G 1/345; F41G 1/35; F41G 1/36; F41G 3/06
USPC ..... 42/114, 115, 116, 117
See application file for complete search history.

(56) References Cited

U.S. PATENT DOCUMENTS 5,509,226 A 4/1996 Houde-Walter
6,237,271 B1 * 5/2001 Kaminski ..... F41A 17/063 42/70.01
7,360,332 B2 4/2008 Rozovsky
8,109,024 B2 * 2/2012 Abst ..... F41A 19/06 124/31
9,490,655 B2 * 11/2016 Cheng ..... H02J 7/025
2006/0026886 A1 * 2/2006 Doukas ..... F41C 33/0254 42/117
2008/0060246 A1 * 3/2008 Rozovsky ..... F41A 17/06 42/70.01
2009/0217565 A1 * 9/2009 Ford ..... F41A 17/08 42/114
2012/0141957 A1 6/2012 Miller
2016/0209171 A1 * 7/2016 Hovsepian ..... F41G 1/35

* cited by examiner

*Primary Examiner* — Stephen Johnson
(74) *Attorney, Agent, or Firm* — IDP Patent Services; Olav M. Underdal

(57) ABSTRACT

A laser sight system for installation in a firearm, includes a proximity sensor; a laser sight assembly, including a laser diode, a laser driver, and an azimuth/elevation adjuster; a laser control unit, including a processor, a non-transitory memory, an input/output, a laser sight controller, a proximity controller, a proximity calibrator, and a data bus; a battery; a charging circuitry; a charging/communication port; and a configuration device; such that the laser control unit activates the laser sight assembly to emit a laser beam, when the proximity sensor detects a finger inside a trigger guard of the firearm. Also disclosed is a method for using the system, including configuring a firearm, activating proximity sensor, calibrating proximity sensor, and activating laser sight.

20 Claims, 11 Drawing Sheets

Laser Sight System With Proximity Detector

Laser Control Unit

Configuration Device

Method of Using Laser Sight System With Proximity Detector

Eccentric Azimuth/Elevation Adjuster

Laser Sight Assembly with Eccentric Azimuth/Elevation Adjuster

LASER SIGHT WITH PROXIMITY SENSOR

CROSS-REFERENCE TO RELATED APPLICATIONS

N/A

FIELD OF THE INVENTION

The present invention relates generally to the field of laser sights used for firearms, and more particularly to methods and systems for automatic activation of laser sights.

BACKGROUND OF THE INVENTION

Laser sights are well known for use with firearms, in the form of a small visible light laser emitter, which is positioned on a gun to facilitate targeting, such that the laser light appears as a small spot on the intended target.

Laser sights have to be activated before use, which normally entails engaging some form of activation switch on the firearm. Activation of the laser can therefore become a distraction and interference during hunting, law enforcement, or military operations, in situations where speed and accuracy is of high importance. Additionally, manual activation of a laser sight can interfere with stealth operations, and increase a risk that a firearm operator is detected prematurely.

As such, considering the foregoing, it may be appreciated that there continues to be a need for novel and improved devices and methods for activating a laser sight on a firearm with minimal disruption.

SUMMARY OF THE INVENTION

The foregoing needs are met, to a great extent, by the present invention, wherein in aspects of this invention, enhancements are provided to the existing models of laser sights to provide automatic activation via the use of proximity sensors.

In an aspect, a laser sight system with proximity sensor, for installation in a firearm, can include a proximity sensor, a laser sight assembly, and a laser control unit, such that the laser control unit can activate the laser sight assembly to emit a laser beam, when the laser control unit receives an activation signal from the proximity sensor.

In a related aspect, the laser sight system can further include a rechargeable battery, which powers the laser sight assembly and the laser control unit.

In another related aspect, the laser sight system can be configured in communication with a configuration device, which can include adjusting a sensitivity threshold of the proximity sensor.

In another related aspect, the laser sight assembly can include an azimuth/elevation adjuster that allows adjusting of the azimuth and elevation of the laser beam.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
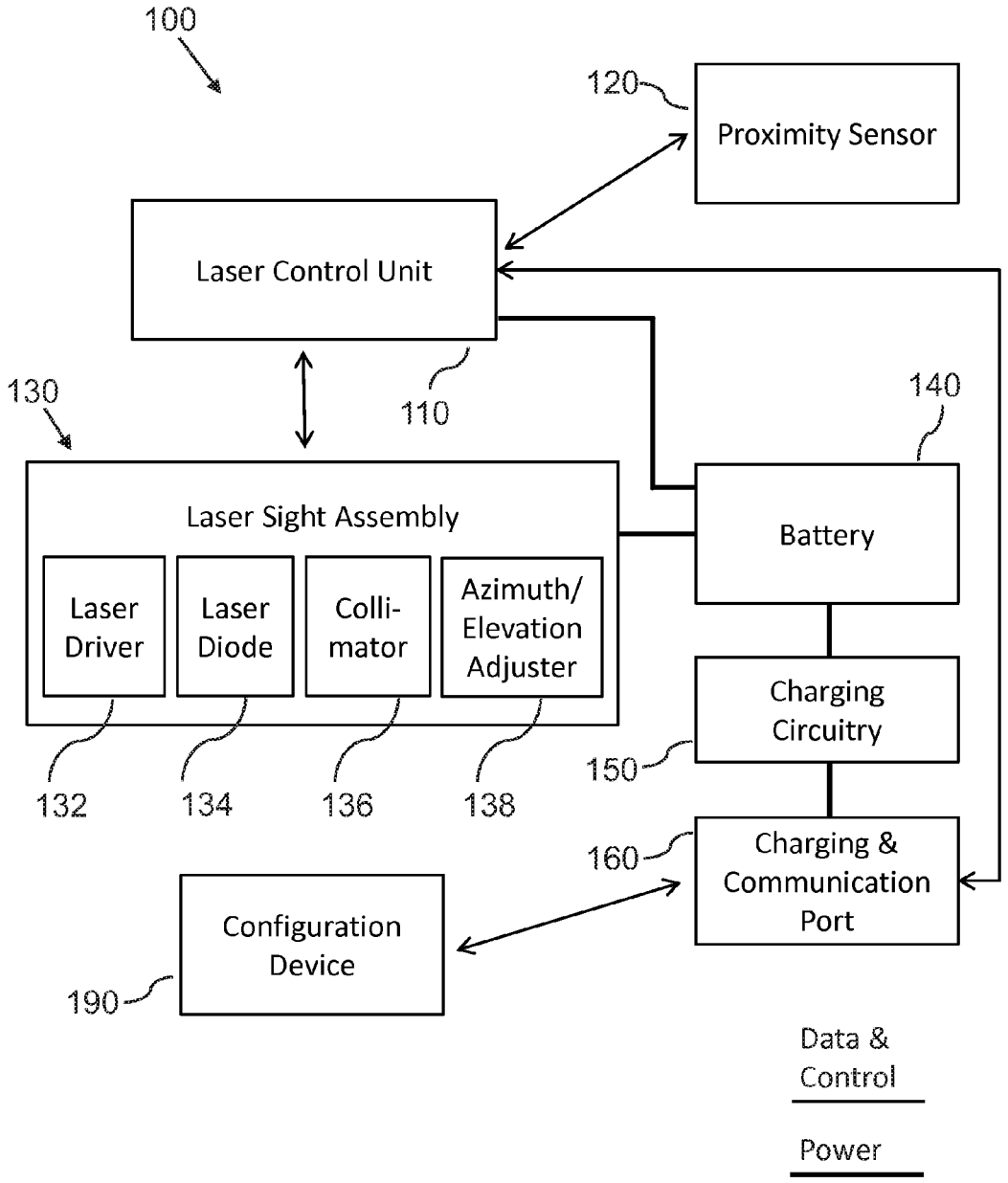
FIG. 1 is a schematic diagram illustrating a laser sight system with proximity detector, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of a laser sight system 100 with reference to FIG. 1, in such manner that like reference numerals refer to like components throughout; a convention that we shall employ for the remainder of this specification.

In an embodiment a laser sight system 100 can include:

a) a proximity sensor 120;

b) a laser sight assembly 130, which can further include:

i. a laser diode 134; and ii. a laser driver 132, which is connected to the laser diode, such that the laser driver is configured to activate the laser diode, whereby the laser diode emits a laser beam;

iii. a collimator 136, which is mounted in a front of the laser diode 134, such that the collimator 136 focuses the laser beam;

iv. an azimuth/elevation adjuster 138, which is mounted in a front of the laser sight assembly 130, such that the azimuth/elevation adjuster 138 adjusts azimuth and elevation of the laser beam;

c) a laser control unit 110, which is connected with the proximity sensor and the laser sight assembly;

d) a battery 140, which is connected to the laser sight assembly 130 and the laser control unit 110;

e) a charging circuitry 150, which can be connected to the battery 140; and f) a charging/communication port 160, wherein the charging/communication port 160 is connected to the charging circuitry 150, such that it provides power to the charging circuitry 150; and wherein the charging/communication port 160 is connected to the laser control unit 110, in order to configure the laser control unit 110;

wherein the laser control unit 110 is configured to activate the laser sight assembly 130, when the laser control unit 110 receives an activation signal from the proximity sensor 120.

Figure 2:
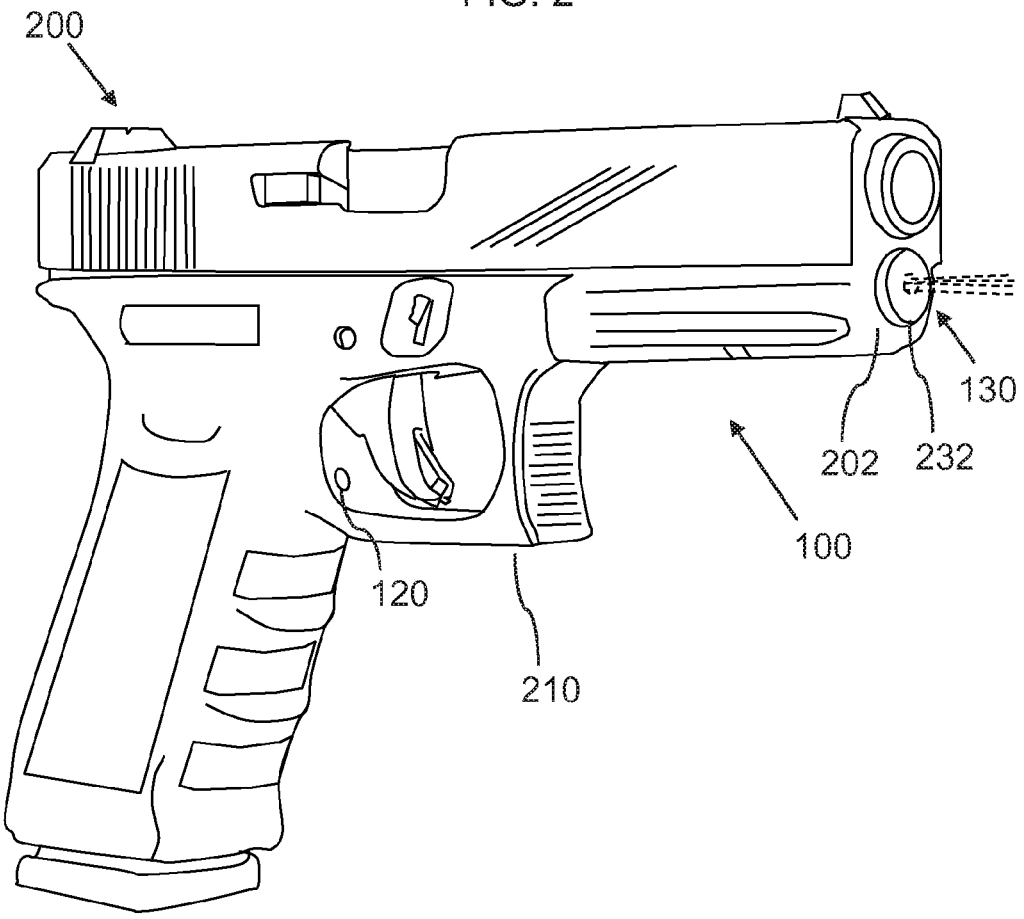
FIG. 2 is a front-side perspective view of a laser sight system with proximity detector, which is installed on a handgun, according to an embodiment of the invention.

In a related embodiment, as shown in FIG. 2, the laser sight system 100 can be installed in a firearm 200, which as shown can be a handgun, such that the proximity sensor 120 is installed inside the trigger guard 210, such that the proximity sensor 120 emits an activation signal when a user of the firearm inserts a trigger finger inside the trigger guard 210, whereby the laser sight assembly 130 automatically activates, in preparation for a potential imminent discharge of the firearm.

In a related embodiment, the laser sight assembly 130 can as shown be mounted underneath the barrel of the firearm, for example in a recoil spring guide chamber. Alternatively, the laser sight assembly can be installed above the barrel, in front of the trigger guard, or in another convenient location for mounting the laser sight assembly 130 to the firearm 200.

In a related embodiment, the collimator 136 can be adjustable, such that an adjustment of the collimator 136 changes a focus of the laser beam. This can for example be configured such that adjustment of the collimator 136 changes a length between the laser diode 134 and the collimator 136.

In a related embodiment, the collimator 136 can be an aspheric lens, which can be made from optical glass, quartz glass, fluorite, optical plastic, or other optical grade transparent materials.

In a related embodiment, the azimuth/elevation adjuster 138 can be configured with an azimuth adjustment screw or nut, to separately adjust an azimuth of the laser beam, and an elevation adjustment screw or nut, to separately adjust an elevation of the laser beam, in accordance with well-known design principles for laser sights.

In a further related embodiment, as shown in FIG. 2, the laser sight assembly 130 can further include a front mounted azimuth/elevation adjustment ring 232, which can be mounted in a front end 202 of the firearm 200, which can allow a user to adjust the azimuth/elevation 138 by turning the ring, either with fingers or by using a tool. Alternatively, adjustment can be facilitated by a screw or nut, such that adjustment is done with a screwdriver or other applicable tool.

Figure 8:
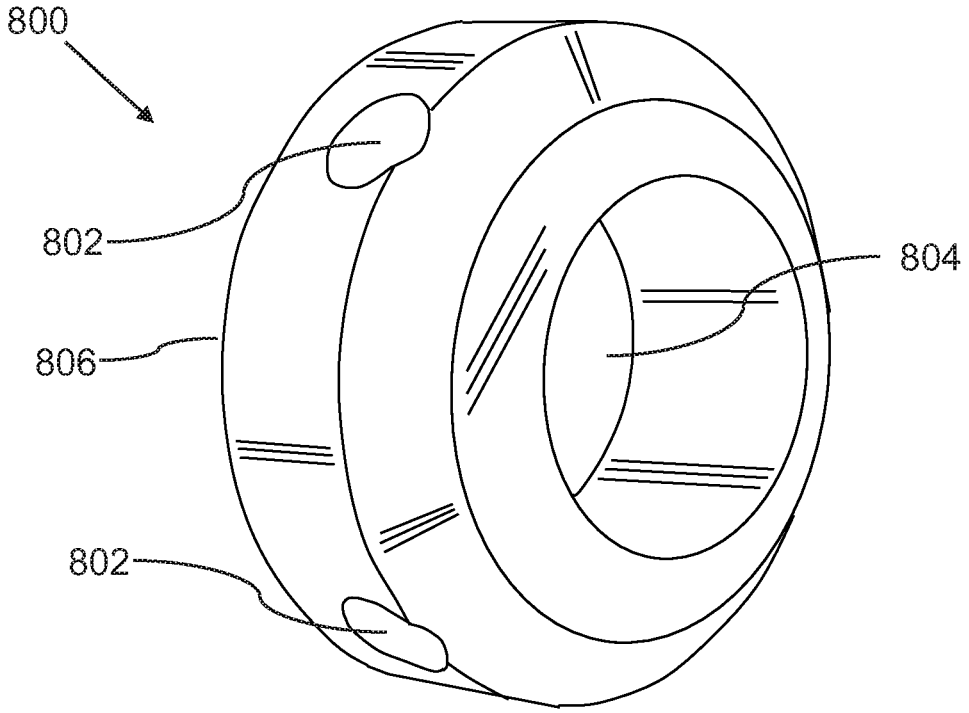
FIG. 8 is a rear-side perspective view of an eccentric azimuth/elevation adjuster, according to an embodiment of the invention.

In a yet further related embodiment, as shown in FIG. 8, which shows a rear perspective view, the front mounted azimuth/elevation adjustment ring 232 can be an eccentric azimuth/elevation adjuster 800, such that a circular periphery 806 of the eccentric azimuth/elevation adjuster 800 can be rotationally mounted inside a circular aperture in a front end of the firearm 200, and a front end of the laser sight assembly 130 can be mounted inside the eccentric aperture 804 of the eccentric azimuth/elevation adjuster 800, such that a rotation of the eccentric azimuth/elevation adjuster 800 causes the end of the laser sight assembly 130 to rotate along an eccentric curve, thereby adjusting azimuth and elevation of the laser beam emitted from the laser sight assembly 130.

In a related embodiment, the eccentric azimuth/elevation adjuster 800 can further include threaded locking screw apertures 802, such that threaded screws can be screwed into the threaded locking screw apertures 802, to lock the rotationally mounted eccentric azimuth/elevation adjuster 800 in a desired position, corresponding to a desired configuration of azimuth and elevation of the laser beam.

Figure 9:
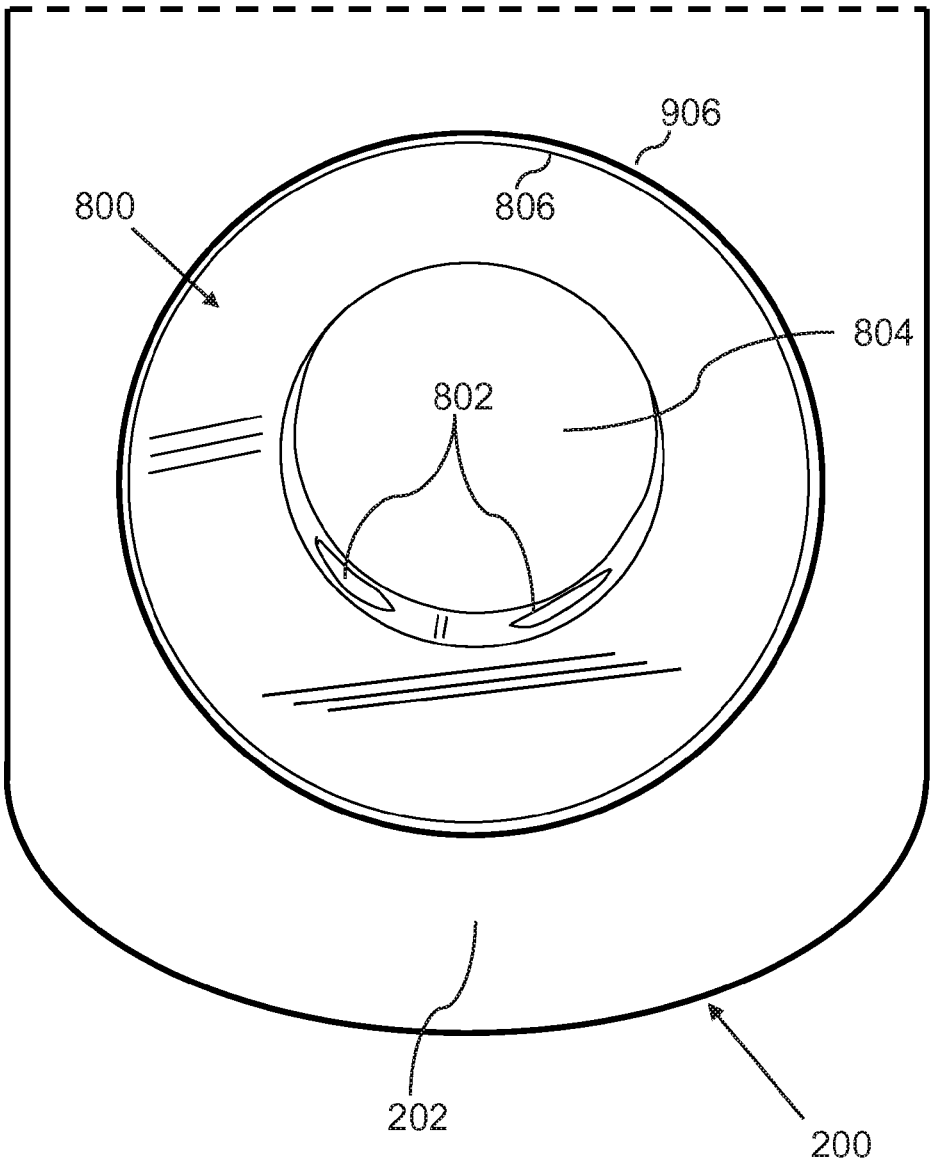
FIG. 9 is a front-side perspective view of an eccentric azimuth/elevation adjuster, mounted in a front end of a firearm, according to an embodiment of the invention.

FIG. 9 shows a front perspective view of the front mounted eccentric azimuth/elevation adjuster 800, mounted in a circular aperture 906, in a front end 202 of the firearm 200, illustrating the eccentric displacement of the eccentric aperture 804, which is configured to hold a front end of the laser sight assembly 130, such that rotation of the eccentric azimuth/elevation adjuster 800 adjusts azimuth and elevation of the laser beam, according to an eccentric curve.

Figure 10:
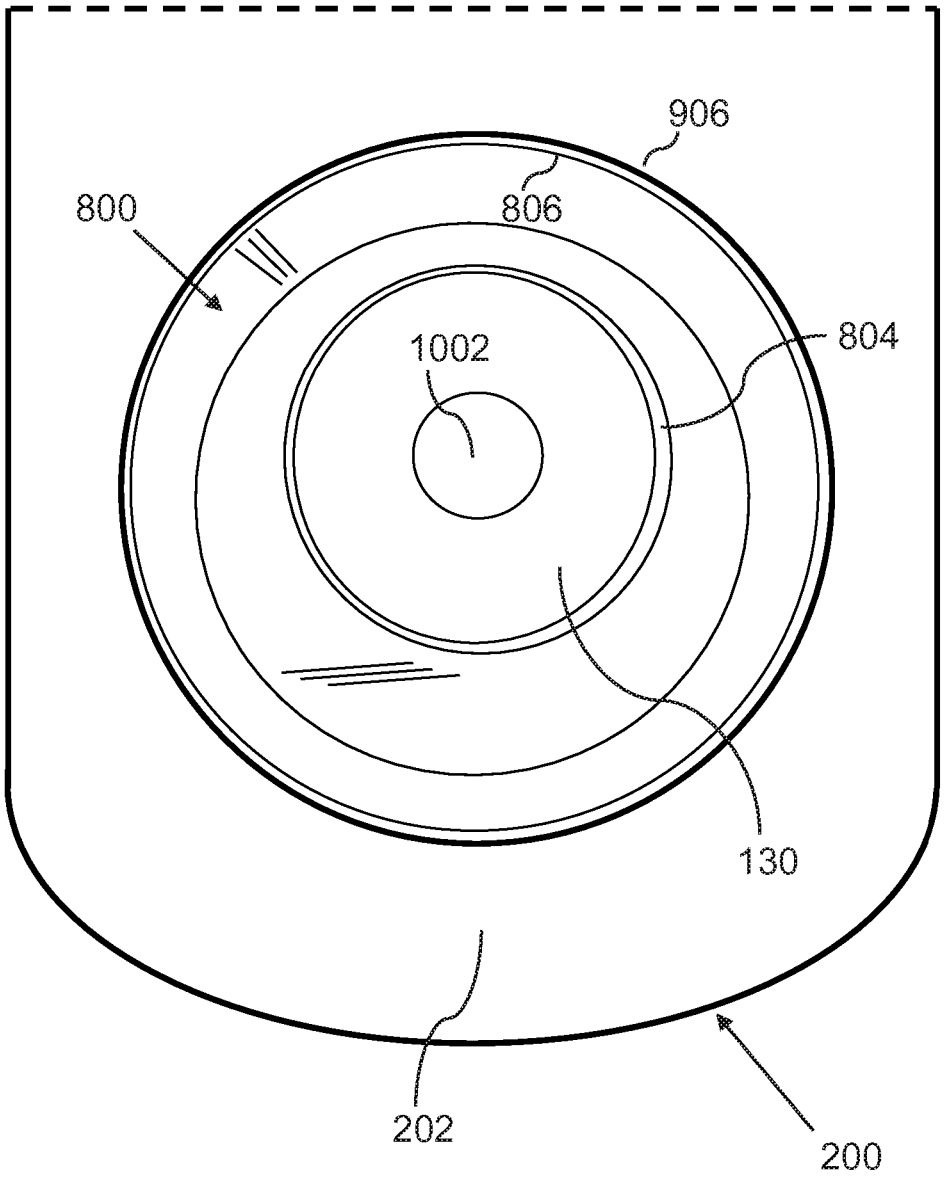
FIG. 10 is a front-side perspective view of an eccentric azimuth/elevation adjuster, mounted with a laser sight assembly in a front end of a firearm, according to an embodiment of the invention.

FIG. 10 shows a front perspective view of the front mounted eccentric azimuth/elevation adjuster 800, including the front end of the laser sight assembly 130, with a laser beam aperture 1002 that emits the laser beam.

Figure 11:
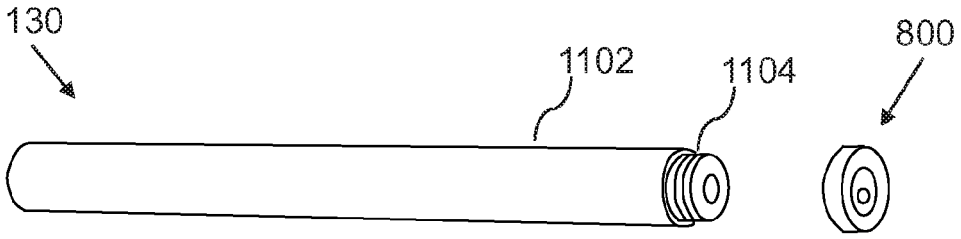
FIG. 11 is a perspective view of a laser sight assembly with an eccentric azimuth/elevation adjuster, in a disassembled state, according to an embodiment of the invention.

In a related embodiment, FIG. 11 shows the laser sight assembly 130, including a mounting mechanism 1104 in a front end of a laser tube 1102 of the laser sight assembly 130, and the eccentric azimuth/elevation adjuster 800 prior to connecting to the mounting mechanism 1104.

Figure 12:
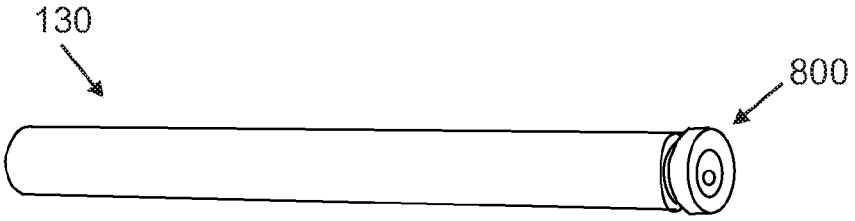
FIG. 12 is a perspective view of a laser sight assembly with an eccentric azimuth/elevation adjuster, in an assembled state, according to an embodiment of the invention.

In a related embodiment, FIG. 12 shows the laser sight assembly 130, with the eccentric azimuth/elevation adjuster 800 mounted in the front.

Figure 3:
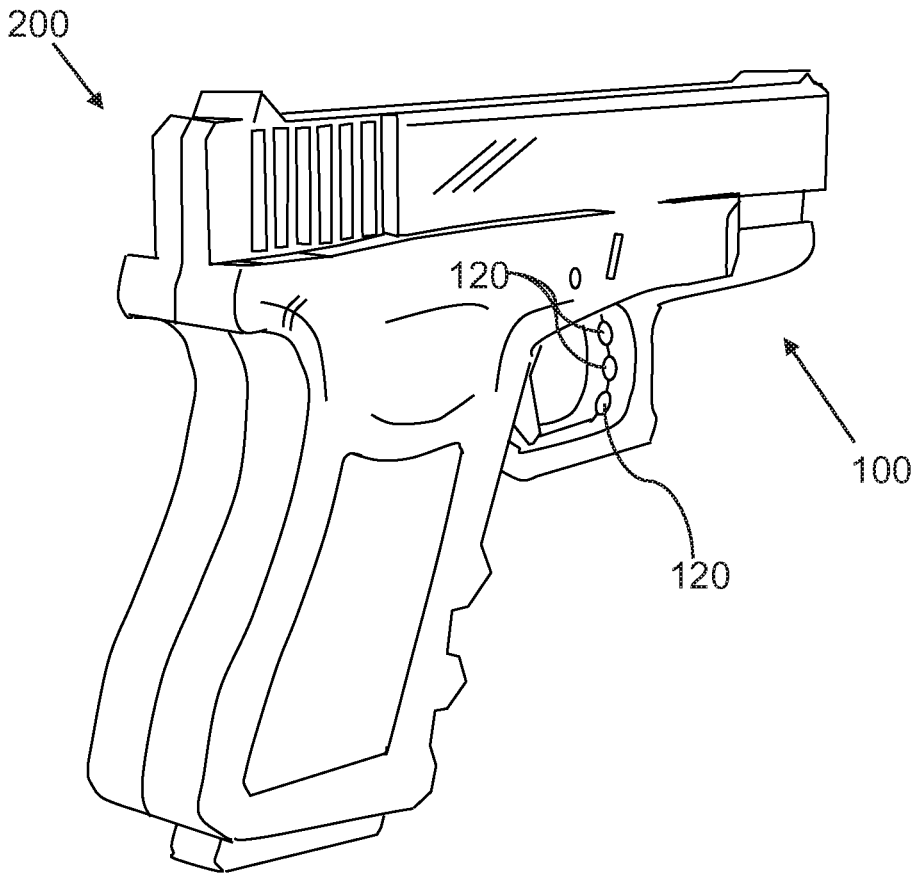
FIG. 3 is a rear-side perspective view of a laser sight system with proximity detector, which is installed on a handgun, according to an embodiment of the invention.

In a related embodiment, FIG. 3 shows three proximity sensors 120 mounted inside a front part of the trigger guard.

Figure 4:
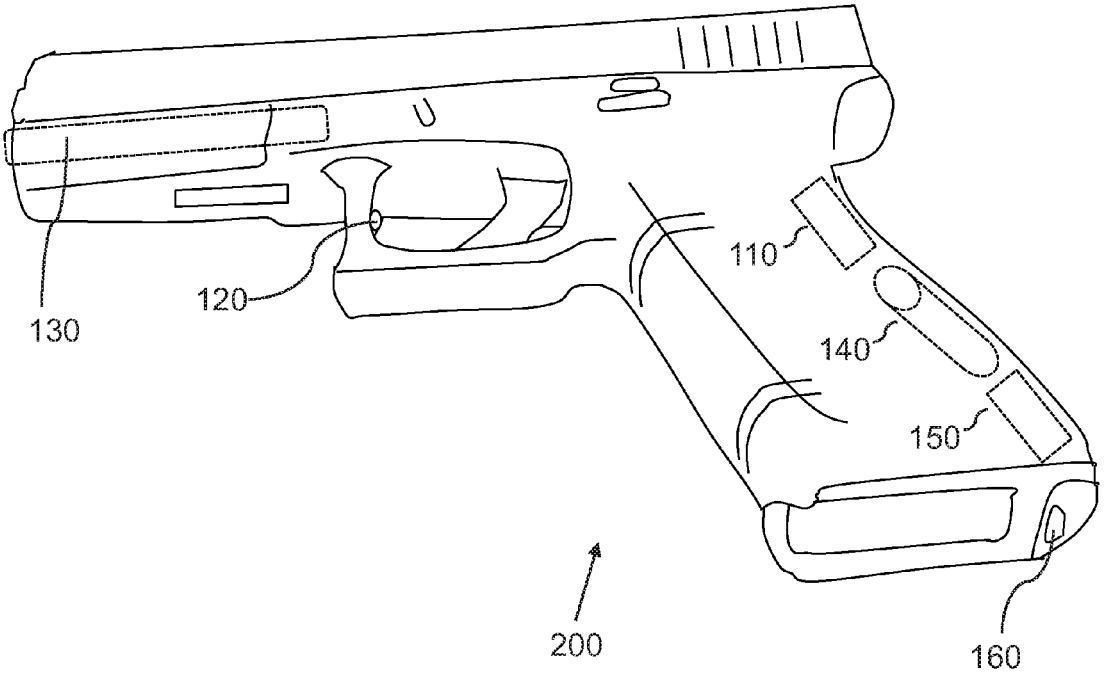
FIG. 4 is a bottom perspective view of a laser sight system with proximity detector, which is installed on a handgun, according to an embodiment of the invention.

In a related embodiment, as shown in FIG. 4, the charging/communication port 160 can be mounted on an underside of a grip of the firearm 200. FIG. 4 further shows the proximity sensor 120, the laser sight assembly 130, the laser control unit 110, the battery 140, and the charging circuitry 150, all mounted inside the firearm 200.

Figure 5:
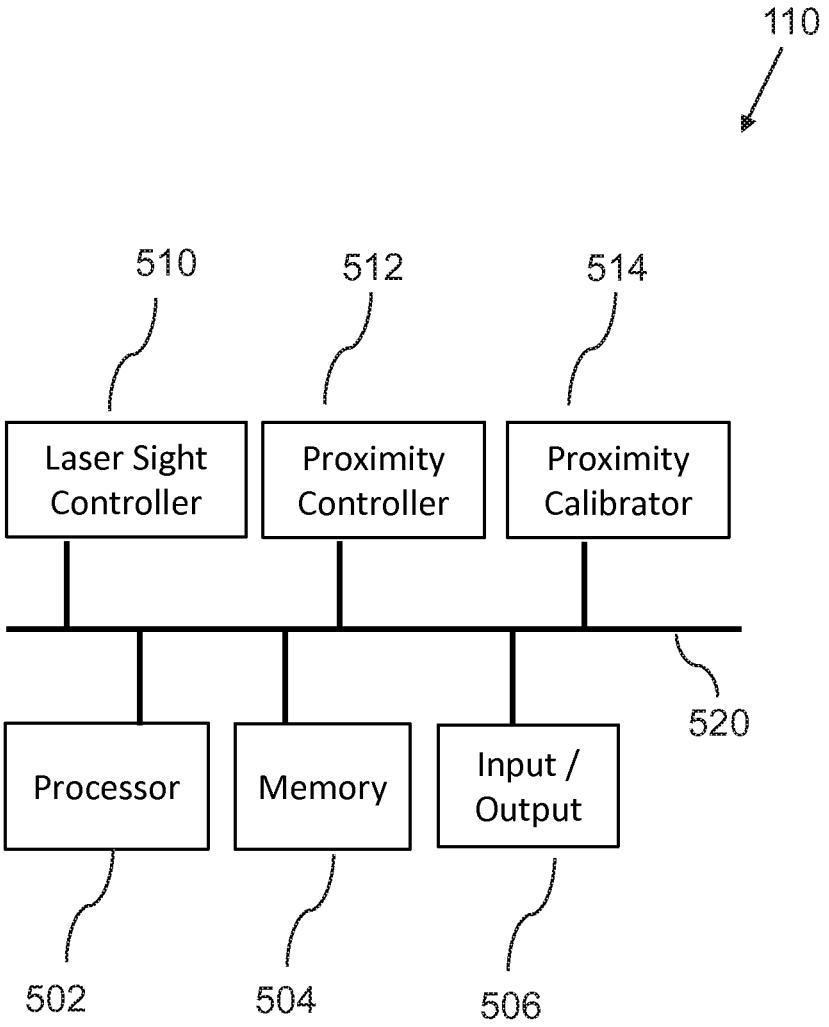
FIG. 5 is a schematic diagram illustrating a laser control unit, according to an embodiment of the invention.

In a related embodiment, as shown in FIG. 5, the laser control unit 110 can be comprised of:

a) A processor 502;
b) A non-transitory memory 504;
c) An input/output 506;
d) A laser sight controller 510;
e) A proximity controller 512;
f) A proximity calibrator 514; all connected via
g) A data bus 520;

Wherein the laser sight controller 510 communicates with the laser sight assembly 130 in order to activate and deactivate the laser sight assembly 130; wherein the proximity controller 512 is configured to communicate with the proximity sensor 120, via the input/output 506, in order to receive an activation signal;

wherein the proximity calibrator 514, is configured to adjust a sensitivity threshold for the activation signal, such that an output from the proximity sensor 120 is an activation signal, if the output exceeds the sensitivity threshold.

In a related embodiment, the proximity sensor 120 can include various well-known designs for proximity sensors, including optical, capacitive and inductive sensors.

In a further related embodiment, the proximity sensor 120 can be a capacitive proximity sensor, that is configured to emit an activation signal when a human finger is placed in proximity to the proximity sensor 120, i.e. in a range of up to 1-3 cm from the proximity sensor 120, but will not emit an activation signal for most other objects, including metal objects, that are placed in proximity to the proximity sensor 120.

Figure 13:
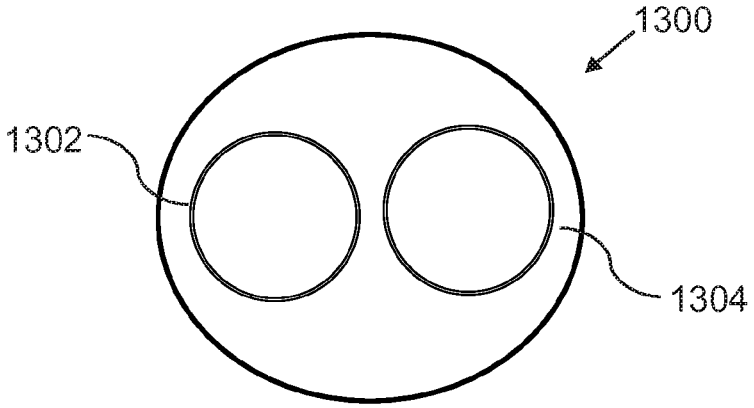
FIG. 13 is a front view of an optical proximity sensor, according to an embodiment of the invention.

In a further related embodiment, the proximity sensor 120 can be an optical proximity sensor 1300, as shown in FIG. 13, which includes an optical transmitter 1302, which transmits a broad-spectrum optical signal, and an optical receiver 1304, which measures a received optical signal from reflection of the broad-spectrum optical signal, such that the optical proximity sensor 1300 is configured to emit an activation signal when an object is placed in proximity to the proximity sensor 120, i.e. in a range of up to 1-3 cm from the optical proximity sensor 1300.

In a yet further related embodiment, the optical proximity sensor 1300 can be configured such that the broad-spectrum optical signal includes infrared radiation.

In a related embodiment, the proximity calibrator 514 can be configured by a configuration device 190, in communication with the charging/communication port 160, such that a sensitivity threshold can be stored by the proximity calibrator 514, in communication via the charging/communication port 160.

In a related embodiment, the proximity calibrator 514 can be configured to register ambient environmental input received by the proximity sensor 120 during start-up, such that the proximity calibrator 514 adjusts the sensitivity threshold to compensate for ambient environmental input, which can be affected by ambient temperature, light level, and other environmental factors.

In a related embodiment the laser sight controller 510 can be configured to check a charging level of the battery 140 during startup/initialization of the laser sight system 100, such that the laser sight controller 510 emits a code by pulsing the laser sight assembly to indicate the charging level of the battery 140. The code can for example be zero pulses for battery almost drained, one pulse for low level charge, two pulses for medium level charge, and three pulses for full charge.

Figure 6:
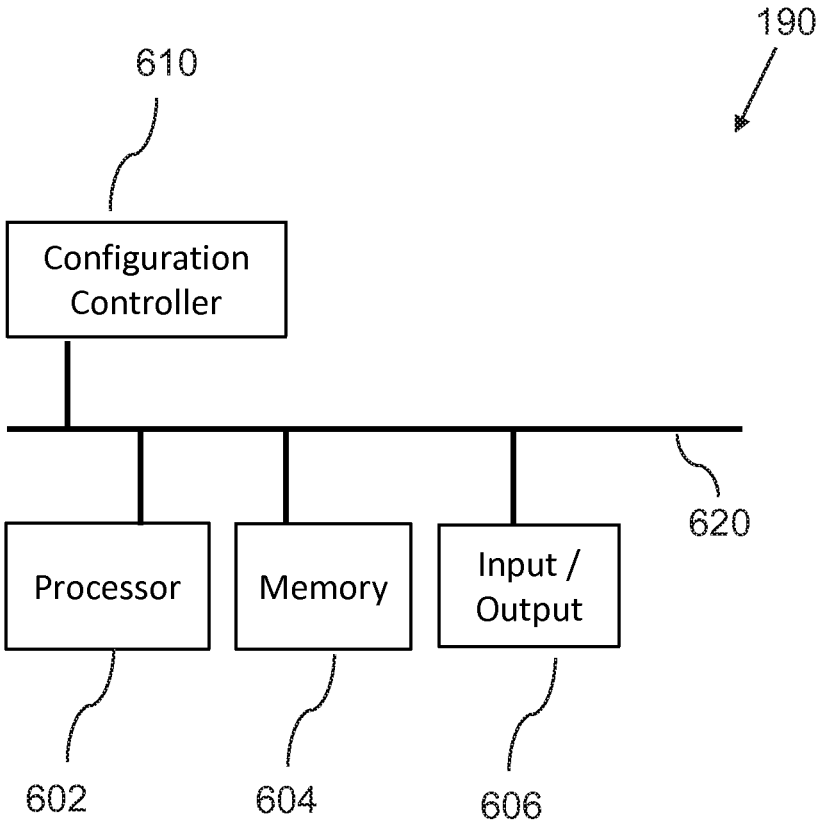
FIG. 6 is a schematic diagram illustrating a configuration device, according to an embodiment of the invention.

In a related embodiment, as shown in FIG. 6, the configuration device 190 can be comprised of:

a) A processor 602;
b) A non-transitory memory 604;
c) An input/output 606; and
d) A configuration controller 610; all connected via
e) A data bus 620;

wherein the proximity calibrator 514 can be configured by the configuration device 190, such that the configuration controller 610 communicates with proximity calibrator 514 via the input/output 606 and the charging/communication port 160, such that a sensitivity threshold can be stored by the proximity calibrator 514.

In a related embodiment, the configuration device 190 can include configurations as:

a) A web application, executing in a Web browser;
b) A tablet app, executing on a tablet device, such as for example an Android or iOS tablet device;
c) A mobile app, executing on a mobile device, such as for example an Android phone or iPhone, or any wearable mobile device;
d) A desktop application, executing on a personal computer, or similar device;
e) An embedded application, executing on a processing device, such as for example a smart TV, a game console or other system.

In a related embodiment, the battery 140 can be rechargeable, such as a rechargeable lithium ion battery.

In a related embodiment, the charging/communication port 160 can be a USB port, including a micro universal serial bus port, also called a micro USB port.

Figure 7:
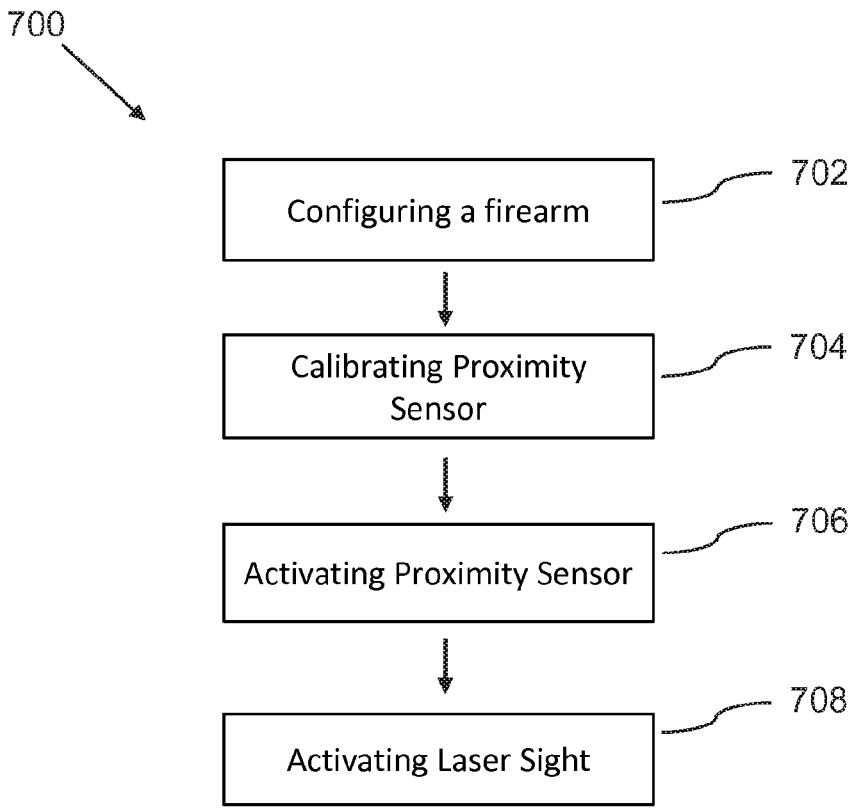
FIG. 7 is a flowchart illustrating steps that may be followed, in accordance with one embodiment of a method or process of using a laser sight system with proximity detector.

In an embodiment, as illustrated in FIG. 7, a method of using a laser sight system with proximity detector 700, can include:

a) Configuring a firearm 702, wherein a firearm 200, can be configured with a laser sight system 100, including a laser sight assembly 130 and a proximity sensor 120;
b) Calibrating proximity sensor 704, wherein a sensitivity threshold for the proximity sensor 120 can be configured;
c) Activating proximity sensor 706, wherein a user of the firearm can insert a finger inside a trigger guard of the firearm 200, such that the proximity sensor 120 emits an activation signal when the proximity sensor 120 detects that the finger is inside the trigger guard 210; and
d) Activating laser sight 708, wherein the laser sight assembly 130 is activated, when the proximity sensor 120 emits the activation signal, such that the laser sight assembly 130 emits a laser beam.

In a further related embodiment, the act of configuring a firearm can further include adjusting azimuth and elevation, wherein an azimuth and an elevation of the laser sight assembly 130 can be adjusted with an azimuth/elevation adjuster 138, which is mounted to the laser sight assembly 130, such that azimuth and elevation of the laser beam is adjusted.

In a further related embodiment, the act of adjusting azimuth and elevation can further include using an eccentric azimuth/elevation adjuster 800 mounted to the laser sight assembly 130, such that the azimuth and the elevation are adjusted according to an eccentric curve.

FIGS. 1, 5, 6, and 7 are block diagrams and flowcharts, methods, devices, systems, apparatuses, and computer program products according to various embodiments of the present invention. It shall be understood that each block or step of the block diagram, flowchart and control flow illustrations, and combinations of blocks in the block diagram, flowchart and control flow illustrations, can be implemented by computer program instructions or other means. Although computer program instructions are discussed, an apparatus or system according to the present invention can include other means, such as hardware or some combination of hardware and software, including one or more processors or controllers, for performing the disclosed functions.

In this regard, FIGS. 1, 5 and 6 depict the computer devices of various embodiments, each containing several of the key components of a general-purpose computer by which an embodiment of the present invention may be implemented. Those of ordinary skill in the art will appreciate that a computer can include many components. However, it is not necessary that all of these generally conventional components be shown in order to disclose an illustrative embodiment for practicing the invention. The general-purpose computer can include a processing unit and a system memory, which may include various forms of non-transitory storage media such as random access memory (RAM) and read-only memory (ROM). The computer also may include nonvolatile storage memory, such as a hard disk drive, where additional data can be stored.

It shall be understood that the above-mentioned components of the laser control unit 110 are to be interpreted in the most general manner.

For example, the processors 502 602 can include a single physical microprocessor or microcontroller, a cluster of processors, a datacenter or a cluster of datacenters, a computing cloud service, and the like.

In a further example, the non-transitory memories 504 604 can include various forms of non-transitory storage media, including random access memory (RAM) and other forms of dynamic storage, and hard disks, hard disk clusters, cloud storage services, and other forms of long-term storage. Similarly, the input/outputs 506 606 can include a plurality of well-known input/output devices, such as screens, keyboards, pointing devices, motion trackers, communication ports, and so forth.

Furthermore, it shall be understood that the laser control unit 110 and the configuration device 190 can each respectively include a number of other components that are well known in the art of general computer devices, and therefore shall not be further described herein. This can include system access to common functions and hardware, such as for example via operating system layers such as Windows, Linux, and similar operating system software, but can also include configurations wherein application services are executing directly on server hardware or via a hardware abstraction layer other than a complete operating system.

An embodiment of the present invention can also include one or more input or output components, such as a mouse, keyboard, monitor, and the like. A display can be provided for viewing text and graphical data, as well as a user interface to allow a user to request specific operations. Furthermore, an embodiment of the present invention may be connected to one or more remote computers via a network interface. The connection may be over a local area network (LAN) wide area network (WAN), and can include all of the necessary circuitry for such a connection.

In a related embodiment, the configuration device 190 can communicate with the laser control unit 110 over a network, which can include the general Internet, a Wide Area Network (WAN) or a Local Area Network (LAN), or another form of communication network, transmitted on wired or wireless connections. Wireless networks can for example include Ethernet, Wi-Fi, Bluetooth, ZigBee, and NFC. The communication can be transferred via a secure, encrypted communication protocol.

Typically, computer program instructions may be loaded onto the computer or other general-purpose programmable machine to produce a specialized machine, such that the instructions that execute on the computer or other programmable machine create means for implementing the functions specified in the block diagrams, schematic diagrams or flowcharts. Such computer program instructions may also be stored in a computer-readable medium that when loaded into a computer or other programmable machine can direct the machine to function in a particular manner, such that the instructions stored in the computer-readable medium produce an article of manufacture including instruction means that implement the function specified in the block diagrams, schematic diagrams or flowcharts.

In addition, the computer program instructions may be loaded into a computer or other programmable machine to cause a series of operational steps to be performed by the computer or other programmable machine to produce a computer-implemented process, such that the instructions that execute on the computer or other programmable machine provide steps for implementing the functions specified in the block diagram, schematic diagram, flowchart block or step.

Accordingly, blocks or steps of the block diagram, flowchart or control flow illustrations support combinations of means for performing the specified functions, combinations of steps for performing the specified functions and program instruction means for performing the specified functions. It will also be understood that each block or step of the block diagrams, schematic diagrams or flowcharts, as well as combinations of blocks or steps, can be implemented by special purpose hardware-based computer systems, or combinations of special purpose hardware and computer instructions, that perform the specified functions or steps.

As an example, provided for purposes of illustration only, a data input software tool of a search engine application can be a representative means for receiving a query including one or more search terms. Similar software tools of applications, or implementations of embodiments of the present invention, can be means for performing the specified functions. For example, an embodiment of the present invention may include computer software for interfacing a processing element with a user-controlled input device, such as a mouse, keyboard, touch screen display, scanner, or the like. Similarly, an output of an embodiment of the present invention may include, for example, a combination of display software, video card hardware, and display hardware. A processing element may include, for example, a controller or microprocessor, such as a central processing unit (CPU), arithmetic logic unit (ALU), or control unit.

Here has thus been described a multitude of embodiments of the laser sight system with proximity detector, and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

Many such alternative configurations are readily apparent, and should be considered fully included in this specification and the claims appended hereto. Accordingly, since numerous modifications and variations will readily occur to those skilled in the art, it is not desired to limit the invention to the exact construction and operation illustrated and described, and thus, all suitable modifications and equivalents may be resorted to, falling within the scope of the invention.

What is claimed is:

1. A laser sight system with proximity sensor, for installation in a firearm, comprising:

a) at least one proximity sensor;

b) a laser sight assembly; and c) a laser control unit, which is connected with the proximity sensor and the laser sight assembly, the laser control unit comprising:

a processor;

a non-transitory memory;

an input/output;

a laser sight controller; and a proximity controller; all connected via a data bus;

wherein the laser control unit is configured to activate the laser sight assembly, when the laser control unit receives an activation signal from the proximity sensor, such that the laser sight assembly emits a laser beam;

wherein the laser sight controller is configured to communicate with the laser sight assembly, via the input/output, in order to activate and deactivate the laser sight assembly;

wherein the proximity controller is configured to communicate with the proximity sensor, via the input/output, in order to receive the activation signal.

2. The laser sight system of claim 1, further comprising:

a battery;

wherein the battery is connected to the laser sight assembly and the laser control unit.

3. The laser sight system of claim 2, further comprising:

a charging circuitry, which is connected to the battery;

wherein the battery is a rechargeable battery;

wherein the charging circuitry is configured to charge the battery.

4. The laser sight system of claim 3, further comprising:

a charging/communication port;

wherein the charging/communication port is connected to the charging circuitry, such that the charging/communication port is configured to provide power to the charging circuitry.

5. The laser sight system of claim 4, further comprising:

a configuration device;

wherein the laser control unit further comprises a proximity calibrator;

wherein the proximity calibrator, is configured to adjust a sensitivity threshold for the activation signal, such that an output from the proximity sensor is an activation signal, if the output exceeds the sensitivity threshold; and wherein the configuration device is connected to the charging/communication port, such that the configuration device is configured to communicate with the proximity calibrator to update the sensitivity threshold, such that an updated sensitivity threshold is stored by the proximity calibrator.

6. The laser sight system of claim 5, wherein the configuration device further comprises:

a) a processor;

b) a non-transitory memory;

c) an input/output; and d) a configuration controller; all connected via e) the data bus;

wherein the configuration controller communicates with the proximity calibrator via the input/output and the charging/communication port, such that the sensitivity threshold is stored by the proximity calibrator.

7. The laser sight system of claim 4, wherein the charging/communication port is a micro universal serial bus port.

8. The laser sight system of claim 1, wherein the laser sight assembly further comprises:

a) a laser diode;

b) a laser driver, which is connected to the laser diode, such that the laser driver is configured to activate the laser diode, whereby the laser diode emits the laser beam;

c) a collimator, which is mounted in front of the laser diode, such that the collimator focuses the laser beam; and d) an azimuth/elevation adjuster, which is mounted in a front of the laser sight assembly, such that the azimuth/elevation adjuster is configured to adjust an azimuth and an elevation of the laser beam.

9. The laser sight system of claim 8, wherein the azimuth/elevation adjuster is an eccentric azimuth/elevation adjuster, which further comprises an eccentric aperture, configured such that a circular periphery of the eccentric azimuth/elevation adjuster is configured to be rotationally mounted inside a circular aperture in a front end of the firearm, and wherein a front end of the laser sight assembly is mounted inside the eccentric aperture of the eccentric azimuth/elevation adjuster.

10. The laser sight system of claim 1, wherein the laser control unit further comprises:

a) a proximity calibrator, which is connected via the data bus;

wherein the proximity calibrator, is configured to adjust a sensitivity threshold for the activation signal, such that an output from the proximity sensor is the activation signal, if the output exceeds the sensitivity threshold.

11. The laser sight system of claim 1, wherein the proximity sensor is a capacitive sensor, such that the capacitive sensor is configured to emit the activation signal when a human finger is placed in proximity to the capacitive sensor, within a range of up to 3 cm from the capacitive sensor.

12. The laser sight system of claim 1, wherein the proximity sensor is an optical proximity sensor, further comprising:

a) an optical transmitter, which transmits a broad-spectrum optical signal; and b) an optical receiver, which measures a received optical signal from reflection of the broad-spectrum optical signal;

such that the optical proximity sensor is configured to emit the activation signal when an object is placed in proximity to the optical proximity sensor, within a range of up to 3 cm from the optical proximity sensor.

13. The laser sight system of claim 12, wherein the optical proximity sensor is configured such that the broad-spectrum optical signal comprises infrared radiation.

14. The laser sight system of claim 1, further comprising:

the firearm, wherein the firearm further comprises a trigger guard;

wherein the laser control unit, the proximity sensor, and the laser sight assembly are each mounted to the firearm;

wherein the proximity sensor is mounted on an inner side of the trigger guard.

15. The laser sight system of claim 1, further comprising:

the firearm, wherein the firearm further comprises a trigger guard;

wherein the laser control unit, the proximity sensor, and the laser sight assembly are each mounted to the firearm;

wherein the proximity sensor is mounted on an inner side of the trigger guard.

16. A laser sight system with proximity sensor, for installation in a firearm, comprising:

a) at least one proximity sensor;

b) a laser sight assembly, comprising:

a laser diode;

a laser driver, which is connected to the laser diode, such that the laser driver is configured to activate the laser diode, whereby the laser diode emits a laser beam;

a collimator, which is mounted in front of the laser diode, such that the collimator focuses the laser beam; and an azimuth/elevation adjuster, which is mounted in a front of the laser sight assembly, such that the azimuth/elevation adjuster is configured to adjust an azimuth and an elevation of the laser beam; and c) a laser control unit, which is connected with the proximity sensor and the laser sight assembly;

wherein the laser control unit is configured to activate the laser sight assembly, when the laser control unit receives an activation signal from the proximity sensor, such that the laser sight assembly emits the laser beam.

17. The laser sight system of claim 16, wherein the azimuth/elevation adjuster is an eccentric azimuth/elevation adjuster, which further comprises an eccentric aperture, configured such that a circular periphery of the eccentric azimuth/elevation adjuster is configured to be rotationally mounted inside a circular aperture in a front end of a firearm, and wherein a front end of the laser sight assembly is mounted inside the eccentric aperture of the eccentric azimuth/elevation adjuster.

18. A laser sight system with proximity sensor, for installation in a firearm, comprising:

a) at least one proximity sensor;

b) a laser sight assembly;

c) a laser control unit, which is connected with the proximity sensor and the laser sight assembly, wherein the laser control unit comprises:

a proximity calibrator;

d) a battery, which is connected to the laser sight assembly and the laser control unit, wherein the battery is a rechargeable battery;

e) a charging circuitry, which is connected to the battery, wherein the charging circuitry is configured to charge the battery;

f) a charging/communication port, which is connected to the charging circuitry, such that the charging/communication port is configured to provide power to the charging circuitry; and g) a configuration device;

wherein the laser control unit is configured to activate the laser sight assembly, when the laser control unit receives an activation signal from the proximity sensor, such that the laser sight assembly emits a laser beam;

wherein the proximity calibrator, is configured to adjust a sensitivity threshold for the activation signal, such that an output from the proximity sensor is the activation signal, if the output exceeds the sensitivity threshold; and wherein the configuration device is connected to the charging/communication port, such that the configuration device is configured to communicate with the proximity calibrator to update the sensitivity threshold, such that an updated sensitivity threshold is stored by the proximity calibrator.

19. The laser sight system of claim 18, wherein the configuration device further comprises:

a) a processor;

b) a non-transitory memory;

c) an input/output; and d) a configuration controller; all connected via e) the data bus;

wherein the configuration controller communicates with the proximity calibrator via the input/output and the charging/communication port, such that the sensitivity threshold is stored by the proximity calibrator.

20. The laser sight system of claim 18, further comprising:

the firearm, wherein the firearm further comprises a trigger guard;

wherein the laser control unit, the proximity sensor, and the laser sight assembly are each mounted to the firearm;

wherein the proximity sensor is mounted on an inner side of the trigger guard.

* * * * *